US010147595B2

(12) United States Patent
Roberts et al.

(10) Patent No.: US 10,147,595 B2
(45) Date of Patent: Dec. 4, 2018

(54) QUADRUPOLE ROD ASSEMBLY

(71) Applicant: Agilent Technologies, Inc., Santa Clara, CA (US)

(72) Inventors: Robert M. Roberts, San Jose, CA (US); James L. Bertsch, Palo Alto, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 15/789,505

(22) Filed: Oct. 20, 2017

(65) Prior Publication Data

US 2018/0174818 A1 Jun. 21, 2018

Related U.S. Application Data

(60) Provisional application No. 62/436,409, filed on Dec. 19, 2016.

(51) Int. Cl.
*H01J 49/42* (2006.01)
*H01J 49/06* (2006.01)

(52) U.S. Cl.
CPC ..... *H01J 49/4215* (2013.01); *H01J 49/063* (2013.01); *H01J 49/4255* (2013.01)

(58) Field of Classification Search
USPC ..... 250/292
See application file for complete search history.

(56) References Cited

U.S. PATENT DOCUMENTS

| | | | | |
|---|---|---|---|---|
| 4,117,321 | A * | 9/1978 | Meyer | H01J 49/421 250/281 |
| 4,158,771 | A | 6/1979 | Beeck et al. | |
| 5,384,461 | A | 1/1995 | Jullien et al. | |
| 5,389,785 | A | 2/1995 | Steiner et al. | |
| 5,852,270 | A | 12/1998 | Holkeboer | |
| 6,329,654 | B1 * | 12/2001 | Gulcicek | H01J 49/063 250/281 |
| 6,417,511 | B1 * | 7/2002 | Russ, IV | H01J 49/063 250/292 |
| 6,909,089 | B2 * | 6/2005 | Londry | H01J 49/4225 250/281 |
| 6,926,783 | B2 * | 8/2005 | Loucks, Jr. | H01J 9/14 156/294 |
| 7,329,879 | B2 | 2/2008 | Kernan et al. | |
| 7,423,262 | B2 | 9/2008 | Mordehai et al. | |

(Continued)

FOREIGN PATENT DOCUMENTS

| | | | |
|---|---|---|---|
| EP | 0000866 | A1 | 3/1979 |
| EP | 0655771 | A1 | 5/1995 |
| JP | 2013149550 | A | 8/2013 |

OTHER PUBLICATIONS

Extended European Search Report issued in counterpart EP Application No. 17206733.2 dated Apr. 19, 2018 (six (6) pages).

*Primary Examiner* — Phillip A Johnston

(57) ABSTRACT

A quadrupole rod assembly includes a plurality of electrically conductive rods, electrically insulating rings coaxially surrounding the rods, and clamping systems. The rods are arranged about a longitudinal axis. The rods and rings have respective surfaces oriented in a transverse plane orthogonal to the longitudinal axis, which surfaces interface with respective surfaces of the clamping systems that are also oriented in the transverse plane.

20 Claims, 8 Drawing Sheets

(56) References Cited

U.S. PATENT DOCUMENTS

| | | | | |
|---|---|---|---|---|
| 2007/0114391 | A1 | 5/2007 | Mordehai et al. | |
| 2013/0261668 | A1* | 10/2013 | Douget | A61B 17/7032 606/278 |

* cited by examiner

QUADRUPOLE ROD ASSEMBLY

RELATED APPLICATIONS

This application claims the benefit under 35 U.S.C. § 119(e) of U.S. Provisional Patent Application Ser. No. 62/436,409, filed Dec. 19, 2016, titled "QUADRUPOLE ROD ASSEMBLY," the content of which is incorporated by reference herein in its entirety.

TECHNICAL FIELD

The present invention relates generally to linear (two-dimensional) multipole rod assemblies, particularly quadrupole rod assemblies, as may be utilized to control the motions of ions or other charged particles.

BACKGROUND

A multipole rod assembly is a device operated to control the motion of ions by generating a radio-frequency (RF) or a composite RF/direct-current (DC) electrical field in an interior region or volume of the device into which ions may be transmitted. The multipole rod assembly includes a set of rods, (i.e., rod-shaped electrodes) that extend in an axial direction. The rods are each positioned at some radial distance from a central, longitudinal axis of symmetry about which the rods are arranged. In the transverse plane orthogonal to the longitudinal axis, the rods are circumferentially spaced from each other. The rods thus coaxially surround and define the interior volume in which ions may be introduced, or in some case produced if an appropriate ionizing device is provided in conjunction with the multipole rod assembly. With this axial geometry, the multipole rod assembly may be referred to as a "linear" or "two-dimensional" multipole rod assembly. Typically, the rods are arranged in parallel with the common longitudinal axis, although in some applications may converge toward or diverge away from the longitudinal axis in the direction from the entrance to the exit of the interior volume. Multipole rod assemblies typically include an even number of rods. Common examples include a quadrupole arrangement (four rods), a hexapole arrangement (six rods), and an octopole arrangement (eight rods), although higher-order multipole arrangements containing more rods are possible.

Electronics provided with the multipole rod assembly include one or more voltage sources communicating with individual rods and/or sets of electrically interconnected rods. The voltages applied to and/or between the rods are configured to generate at least a two-dimensional, time-varying RF electric field in the interior volume. This RF electric field generally extends along the entire length of the rods and thus along the entire length of the interior volume surrounded by the rods. Accordingly, an ion generally at any location in the interior volume will be exposed to and influenced by the RF electric field. The RF electric field is configured (i.e., as to spatial orientation and energy distribution) to confine the motions of ions in the interior volume to the vicinity of the longitudinal axis. That is, the RF electric field focuses the ions into an ion beam at the longitudinal axis. The operating parameters of the RF field (voltage amplitude and frequency) determine whether the motion or trajectory of an ion of a given mass-to-charge ratio (or m/z ratio, or more simply "mass") is stable or unstable in the RF electric field. A stable ion can travel through the full length of the multipole rod assembly as part of the focused beam and exit the multipole rod assembly. An unstable ion will deviate from the focused beam without being sufficiently repelled by the RF electric field back toward the center (longitudinal axis) of the interior volume, and consequently will impact a rod and be neutralized thereby or escape the interior volume through the space between a pair of adjacent rods. A multipole rod assembly operated as an RF-only ion guide can potentially transmit a broad range of ions (ions having a broad range of m/z ratios).

In the special case of a quadrupole rod assembly, DC voltages can be superposed on the RF voltages applied to the rods to generate a composite RF/DC electric field in the interior volume. The composite RF/DC electric field, defined by well-known mathematical relations in the case of a quadrupole arrangement, not only focuses the ions as an ion beam on the longitudinal axis but also imposes an m/z ratio passband on the transmission of ions through the quadrupole rod assembly. The limits or end points of the m/z ratio passband (the low-mass cutoff point and high-mass cutoff point), and the width of the m/z ratio passband between the low-mass and high-mass cutoff points, are dictated by the operating parameters of the composite RF/DC electric field (RF voltage amplitude and frequency, and DC voltage magnitude). For example, the m/z ratio passband may be configured to pass only ions having a particular m/z ratio (e.g., m/z=105), or ions falling within a narrow range of m/z ratios (e.g., m/z=100 to m/z=110). Ions transmitted into the quadrupole rod assembly having m/z ratios falling in the m/z ratio passband will have stable trajectories and thus a high probability of passing through the full length of the multipole rod assembly and exiting therefrom. On the other hand, ions transmitted into the quadrupole rod assembly having m/z ratios outside of the /z ratio passband will have unstable trajectories and thus will not successfully traverse the full length of the multipole rod assembly and exit therefrom, i.e., such ions will be rejected by the quadrupole rod assembly. Moreover, as the stability of an ion depends on its m/z ratio as well as the operating parameters of the composite RF/DC electric field, one or more of the operating parameters can varied over time, which has the effect of scanning ion masses in succession. For example, the ions may be scanned such that ions of m/z=100 are transmitted (selected) while all other ions are rejected, then ions of m/z=101 are transmitted while all other ions are rejected, then ions of m/z=103 are transmitted while all other ions are rejected, and so on. A quadrupole rod assembly generating such a composite RF/DC electric field may thus be utilized as a mass-selective device such as a mass filter or mass analyzer.

One common application for such a quadrupole rod assembly is a mass spectrometry (MS) system having a "triple-quad" or "QqQ" configuration. The triple-quad MS system includes a first-stage mass filter or mass analyzer, followed by a collision cell, and in turn followed by a second-stage mass filter or mass analyzer. A sample of material to be analyzed is ionized, and the resulting analyte ions are transmitted into the first-stage mass filter or mass analyzer as "precursor" ions. Typically, the first-stage mass filter or mass analyzer selects precursor ions of one selected m/z ratio for further transmission into the collision cell. The collision cell fragments these precursor ions into product (or fragment) ions, which have a range of m/z ratios smaller than the m/z ratio of the precursor ions, and transmits these product ions to the second-stage mass filter or mass analyzer. The second-stage mass filter or mass analyzer then transmits the product ions to an ion detector, often in accordance with a scanning function. The ion detector outputs electrical signals to electronics for signal processing as needed to generate a mass spectrum representative of characteristics of the sample. In such an application, a quadrupole rod assembly is often employed as the first-stage mass filter or mass analyzer and/or the second-stage mass filter or mass analyzer. A quadrupole rod assembly may also be employed as an RF-only ion guide in the collision cell (hence the traditional name "triple-quad"), although more often the collision cell utilizes a multipole rod assembly of higher order (e.g., a hexapole or octopole).

From the foregoing, it is evident that to ensure a quadrupole rod assembly processes ions in an accurate, predictable, and repeatable manner, the electric field(s) generated and maintained by the quadrupole rod assembly should be as pure and uniform as possible over the entire axial length of the quadrupole rod assembly. This means that any unintended perturbations or defects in the electric field(s), such as may be manifested by fringing effects, non-linearities, and localized higher-order fields, should be minimized as much as possible. The physical geometry of the rods, particularly their surfaces that face the interior volume and to which the ions are thus exposed, and the relative positions of the rods, have a direct effect on the purity and uniformity of the electric field(s). Hence, it is critical that a quadrupole rod assembly be fabricated and assembled in a precise manner, with minimal tolerances. The surface of each rod facing the interior volume should be accurately shaped. The shape of each rod should be uniform along the entire axial length of the rod, and should be the same as the shapes of the other rods as much as possible (i.e., with minimal tolerances). The distance of each rod from the other rods should be uniform along the entire axial length of each rod as much as possible (i.e., with minimal tolerances).

Moreover, the foregoing attributes must be as insensitive to temperature as possible, i.e., thermal expansion should be minimized as much as possible. The maximization of temperature insensitivity in quadrupole rod assemblies is an ongoing challenge. The fixing of the positions of the rods in space and the mounting of the rods in an instrument require the use of electrically insulating components and mounting hardware. The materials utilized for the electrically conductive rods and the materials utilized for the electrically insulating components are necessarily different and thus have different coefficients of thermal expansion. The material composition of the mounting hardware is also different from the rods and/or the electrically insulating components. Consequently, as electrical power is applied to the rods during operation, the rods, electrically insulating components, and mounting hardware are heated and undergo thermal expansion to different degrees, which can lead to distortions in the geometry and position of the rods and consequently impurities and non-uniformities in the electric field(s).

Generally, the foregoing considerations apply to higher-order multipole rod assemblies as well. However, the desired level of precision in the positioning of the rods and the temperature insensitivity of the rod assemblies can be less rigorous, as higher-order multipole rod assemblies are not utilized to select or scan ions on the basis of m/z ratios, and thus a greater degree of field impurity and non-uniformity is acceptable in comparison to quadrupole rod assemblies utilized as mass-selective devices.

In view of the foregoing, there is an ongoing need for providing quadrupole rod assemblies, and by extension higher-order multipole rod assemblies, with improved geometric and positional precision and temperature insensitivity.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, a quadrupole rod assembly includes: at least four electrically conductive rods elongated along a longitudinal axis, the rods being circumferentially spaced from each other in a transverse plane orthogonal to the longitudinal axis, and positioned at a radius $R_o$ from the longitudinal axis, each rod comprising a plurality of rod contact surfaces in the transverse plane; an electrically insulating first ring coaxially surrounding and spaced from the rods by a first radial gap, the first ring comprising a first ring face and an opposing second ring face in the transverse plane; an electrically insulating second ring coaxially surrounding and spaced from the rods by a second radial gap, the second ring comprising a third ring face and an opposing fourth ring face in the transverse plane; a first clamping system comprising a plurality of first clamping faces in the transverse plane and a plurality of second clamping faces in the transverse plane, wherein each first clamping face spans the radial gap and is in contact with the first ring face and a respective rod contact surface, each second clamping face spans the radial gap and is in contact with the second ring face and a respective rod contact surface, and the first ring and the rods are clamped between the first clamping faces and the second clamping faces such that the first ring and the rods are spatially fixed relative to each other; and a second clamping system comprising a plurality of third clamping faces in the transverse plane and a plurality of fourth clamping faces in the transverse plane, wherein each third clamping face spans the radial gap and is in contact with the third ring face and a respective rod contact surface, each fourth clamping face spans the radial gap and is in contact with the fourth ring face and a respective rod contact surface, and the second ring and the rods are clamped between the third clamping faces and the fourth clamping faces such that the second ring and the rods are spatially fixed relative to each other.

According to another embodiment, an ion processing device includes: a quadrupole rod assembly according to any of the embodiments disclosed herein; and a voltage source communicating with the rods, wherein the rods are configured for generating a quadrupole electric field in an interior volume surrounded by the rods.

According to another embodiment, a spectrometry system includes: a quadrupole rod assembly according to any of the embodiments disclosed herein; and an ion detector configured to receive ions transmitted from the quadrupole rod assembly Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
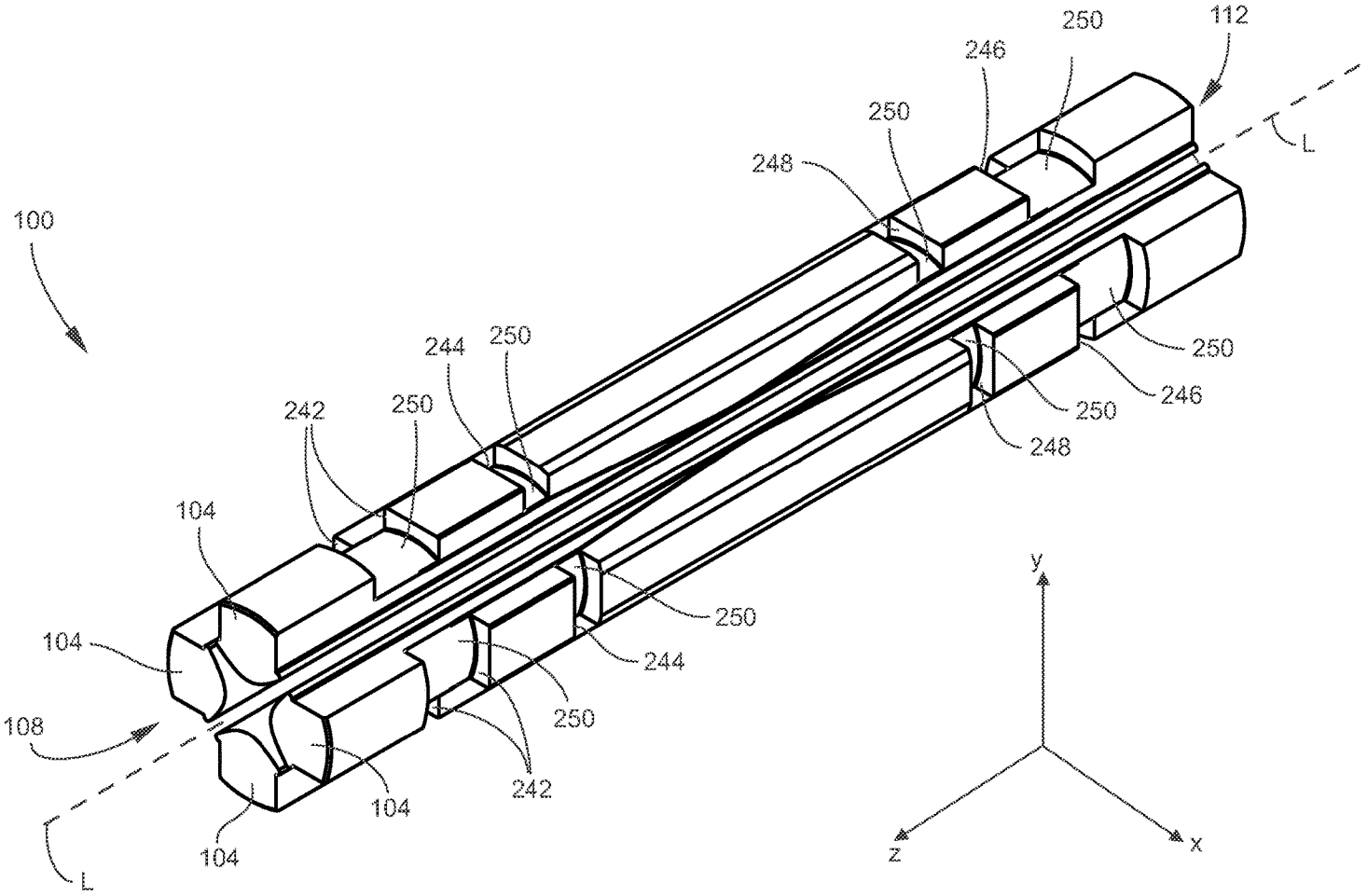
FIG. 1 is a perspective view of an example of a set or arrangement of rods that may be provided in a quadrupole rod assembly according to an embodiment of the present disclosure.

The present disclosure generally relates to linear (two-dimensional) multipole rod assemblies in which rods (rod-shaped electrodes) are arranged in parallel with a common longitudinal axis. In particular, the present disclosure relates to linear quadrupole rod assemblies. In a typical embodiment, the quadrupole rod assembly is configured as a device for controlling the motions of ions present in an interior volume of the quadrupole rod assembly surrounded by the rods. That is, the quadrupole rod assembly is configured as an ion processing (or ion manipulating) device. In a typical embodiment, the quadrupole rod assembly is configured and operated as a mass-selective (or mass analyzing) device. That is, with the application of appropriate voltages to the rods (described below), the quadrupole rod assembly is capable of generating electric fields effective for sorting or separating ions based on their differing mass-to-charge (m/z) ratios. Thus, the quadrupole rod assembly may be operated as a linear mass filter or mass analyzer. The quadrupole rod assembly further may be capable of storing ions in its interior volume for a desired amount of time and thereafter releasing the ions for transmission to another device outside of the quadrupole rod assembly. Thus, the quadrupole rod assembly may be operated as a linear ion trap with axial and/or radial ion ejection. In other embodiments, the quadrupole rod assembly may more simply be operated as a linear ion guide that transports ions as a focused ion beam from one axial end to the other axial end of the quadrupole rod assembly, without active mass selection or trapping/storing. A linear ion guide may be utilized in an ion processing device that provides an additional function such as, for example, ion beam cooling, ion fragmentation, etc. Examples of instruments or systems in which the quadrupole rod assembly may be deployed include, but are not limited to, mass spectrometers, ion mobility spectrometers, tracer-gas leak detectors, ion implantation systems, etc. The general structure and operation of multipole-based ion guides, mass analyzers, ion traps and the like, as well as associated instruments or systems in which such multipole-based devices are utilized, are known to persons skilled in the art, and thus need not be described in detail in the present disclosure.

In a representative embodiment of the present disclosure, a quadrupole rod assembly includes a plurality of electrically conductive rods, a plurality of electrically insulating rings, and a plurality of clamping systems. The clamping systems are configured to provide structural support for the rods and the rings. In particular, the clamping systems are configured to spatially fix, locate, and align the rods and the rings relative to each other in a highly precise manner, such that the rods are accurately positioned at predefined distances relative to each other, the rings are accurately positioned at predefined distances relative to each other, and each rod positioned at a predefined distance relative to each ring. The quadrupole rod assembly is configured such that the predefined distances have minimal tolerances and are largely temperature-insensitive over the range of operating temperatures contemplated for the quadrupole rod assembly. In one non-limiting example, the operating temperature may range from typical ambient room temperature (5 C° C. to 35° C.) to about 120° C. In another non-limiting example, due to intentional (or unavoidable) heating, the maximum operating temperature may be up to 200° C. In another non-limiting example, the upper limit of the operating temperature may extend higher than 200° C. By comparison, the useful operating temperature of one conventional quadrupole rod assembly is 70° C. to 100° C.

The quadrupole rod assembly includes four rods. The rods are elongated along a longitudinal axis of the quadrupole rod assembly, in parallel with each other and with the longitudinal axis. The quadrupole rod assembly is axisymmetrical about the longitudinal axis, and thus the longitudinal axis corresponds to the central axis (of symmetry) of the quadrupole rod assembly. The rods are circumferentially spaced from each other about the longitudinal axis, at equal angular intervals in a transverse plane orthogonal to the longitudinal axis. In the quadrupole rod assembly, the four rods are thus circumferentially spaced at 90° intervals. Each rod is positioned at a radius Ro from the longitudinal axis. That is, the closest point of each rod to the longitudinal axis along a radial direction orthogonal to the longitudinal axis is at a distance of Ro. Each rod includes a plurality of rod contact surfaces lying in the transverse plane, as described below.

The four-rod (quadrupole) configuration is advantageous for configuring the quadrupole rod assembly as a linear mass-selective device according to known principles. The highly precise positioning and alignment provided by the presently disclosed quadrupole rod assembly enables the generation of highly uniform electric fields in the interior volume of the quadrupole rod assembly, and thus the presently disclosed quadrupole rod assembly is particularly advantageous for use as a mass-selective device. In other embodiments the rod assembly may include more than four rods (e.g., a hexapole rod assembly in the case of six rods, an octopole rod assembly in the case of eight rods, etc.), and thus more generally may be considered as being a multipole rod assembly that includes at least four rods. Such higher-order multipole rod assemblies are typically utilized as ion guides and do not provide mass-analyzing functionality. For convenience, the term "quadrupole" as used herein is interchangeable with the term "multipole" unless specified otherwise or the context dictates otherwise.

The electrically insulating rings coaxially surround the rods relative to the longitudinal axis. The rings are spaced from the rods by a radial gap, such that an annular space exists between the rods and each ring. Each ring includes opposing axial ring faces lying in the transverse plane. In a typical embodiment, the quadrupole rod assembly includes two rings, namely a first ring and a second ring. The first ring includes a first axial ring face and an opposing second axial ring face in the transverse plane, and the second ring includes a third axial ring face and an opposing fourth axial ring face in the transverse plane. The first ring and the second ring may be spaced at equal axial distances (along the longitudinal axis) from the respective axial ends of the quadrupole rod assembly. In other embodiments the quadrupole rod assembly may include more than two rings, and thus the quadrupole rod assembly more generally may be considered as including at least two rings.

In a representative embodiment, the quadrupole rod assembly includes at least a first clamping system and a second clamping system. The first clamping system includes a plurality of first clamping faces lying in the transverse plane and a plurality of second clamping faces lying in the transverse plane. The first clamping faces and the second clamping faces span the radial gap between the rods and the first ring. Each first clamping face is in contact with the first ring face and a respective rod contact surface, and each second clamping face is in contact with the second ring face and a respective rod contact surface. The first clamping system is configured such that, in assembled form, the first ring and the rods are clamped between the first clamping faces and the second clamping faces such that the first ring and the rods are spatially fixed relative to each other, as described further below.

Similarly, the second clamping system includes a plurality of third clamping faces lying in the transverse plane and a plurality of fourth clamping faces lying in the transverse plane. The third clamping faces and the fourth clamping faces span the radial gap between the rods and the second ring. Each third clamping face is in contact with the third ring face and a respective rod contact surface, and each fourth clamping face is in contact with the fourth ring face and a respective rod contact surface. The second clamping system is configured such that, in assembled form, the second ring and the rods are clamped between the third clamping faces and the fourth clamping faces such that the second ring and the rods are spatially fixed relative to each other, as described further below.

Figure 2:
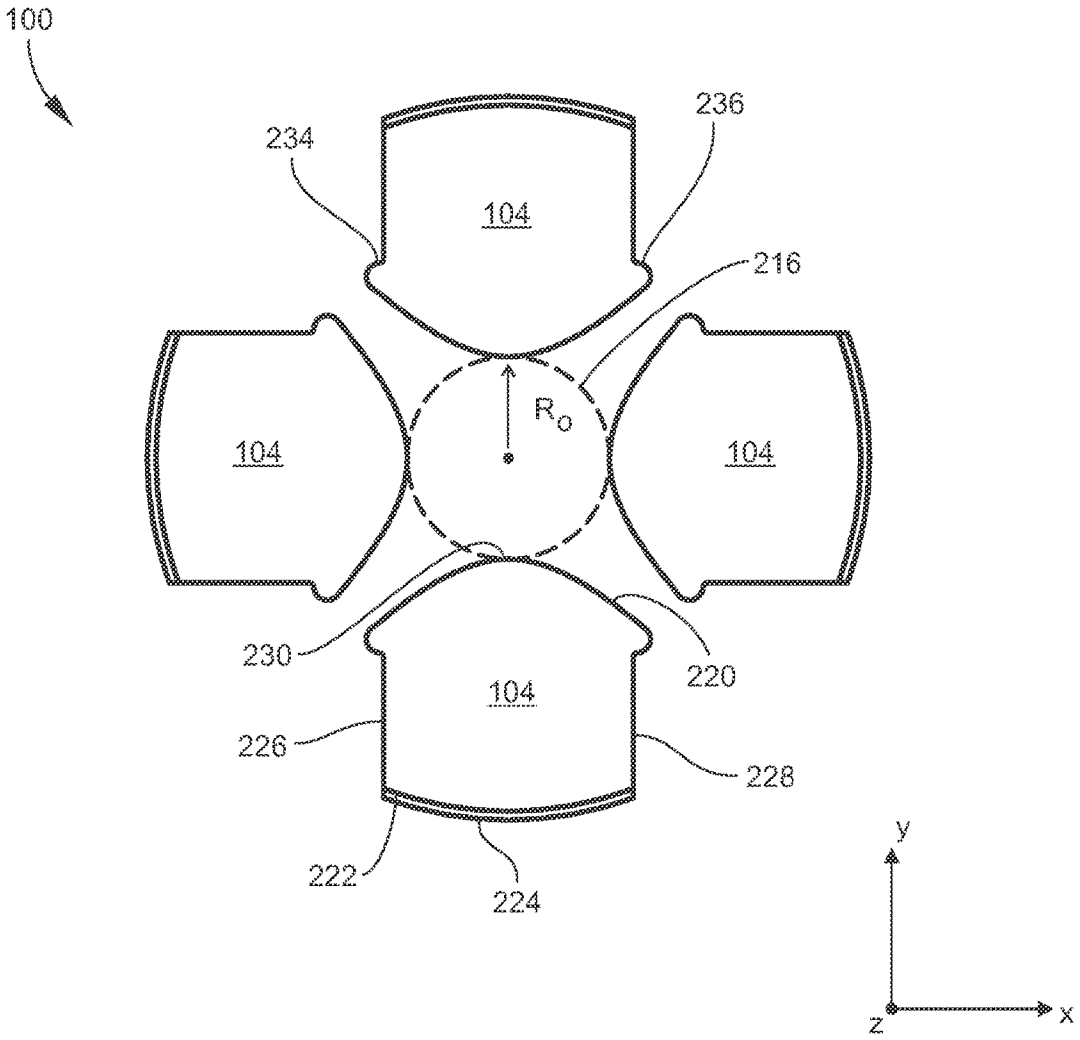
FIG. 2 is an axial end view of the rod set illustrated in FIG. 1.

FIG. 1 is a perspective view of an example of a set or arrangement 100 of rods 104 that may be provided in a quadrupole rod assembly according to an embodiment of the present disclosure. FIG. 2 is an axial end view of the rod set 100. For descriptive purposes, FIGS. 1 and 2 include a Cartesian coordinate frame of reference defined by mutually orthogonal x-, y-, and z-axes. The z-axis corresponds to a longitudinal axis L passing through the geometric center of the rod set 100. The x-y plane, also referred to herein as the transverse plane, is orthogonal to the z-axis, with the x-axis and y-axis extending in radial directions from the longitudinal axis L (z-axis).

The rods 104 are elongated along the longitudinal axis L, in parallel with each other and with the longitudinal axis L. The rods 104 extend along the longitudinal axis L from a first axial end 108 to an opposing second axial end 112 of the rod set 100, which in operation serve as an ion entrance end and an ion exit end, respectively. The rods 104 are circumferentially spaced from each other at equal angular intervals in a transverse plane. In the present embodiment in which four rods 104 are provided, the rods 104 are circumferentially spaced at ninety-degree intervals from each other. Thus, the rod set 100 includes two radially opposing pairs of rods 104, e.g., two "x-rods" positioned on the x-axis and two "y-rods" positioned on the y-axis. Each rod 104 is positioned at a radius Ro (FIG. 2) from the longitudinal axis L. By this configuration, the rods 104 coaxially surround or inscribe an interior volume 216 (FIG. 2) that likewise has a radius Ro and extends from the first axial end 108 to the second axial end 112.

When assembled in an instrument, the rods 104 are placed in electrical communication with radio frequency (RF) voltage sources, or both RF and direct-current (DC) voltage sources. In a typical operation, a first RF voltage of appropriate amplitude and frequency is applied between one radially opposing pair of rods 104 (e.g., the two x-rods), and a second RF voltage of the same amplitude and frequency as the first RF voltage, but shifted 180 degrees in phase from the first RF voltage, is applied between the other opposing pair of rods 104 (e.g., the two y-rods). The rods 104 so powered generate a time-varying (RF) quadrupole electric field in the interior volume 216 configured to focus ions as a beam on the longitudinal axis L. Although FIG. 2 depicts the interior volume 216 as a circular area, it will be understood that this is a symbolic simplification and the actual volume that ions can occupy while being transmitted, depending on a variety of factors, may include some of the area between adjacent rods 104 that is outside of the Ro circle 216 as drawn. Ions may enter the interior volume via the first axial end 108. If only the RF field is applied, the rod set 100 operates as an "RF-only" ion guide. In this case, ions of a relatively broad mass range may be transmitted through the interior volume 216 along the longitudinal axis L toward the second axial end 112. If the trajectories of such ions remain stable in the RF field and the ions are not ejected from the interior volume 216, such ions may travel the full axial length of the interior volume 216 and exit therefrom via the second axial end 112. Additionally, the rod set 100 may be operated as a mass-selective device, e.g., a mass analyzer or mass filter. In this case, DC voltages of appropriate magnitude and polarity are applied to the rods 104 in addition to the RF voltages in a manner that imposes a narrow mass range, bounded by selected low-mass and high-mass cut-off points, on ion transmission through the interior volume 216. By this configuration, ions whose masses fall within the narrow mass range, or even ions of only a single mass, may be selectively transmitted out from the rod set 100 while other ions are rejected. One or more operating parameters of the RF and/or DC voltages may be varied over time so as to scan the mass range of ions entering the interior volume 216, whereby ions of different masses may be selected and transmitted out from the rod set 100 in succession (e.g., first m/z=100, then m/z=105, then m/z=110, etc.). The rod set 100 may also be operated as an ion trap by providing ion optics (e.g., lenses, not shown) at the axial ends 108 and 112 or other means for creating potential barriers (i.e., on/off ion gates) at the axial ends 108 and 112. Such an ion trap may be operated with or without mass selection. In some embodiments, a longitudinal slot may be formed through one or more of the rods 104 to allow radial ejection of ions through the slot(s).

As best shown in FIG. 2, the lateral outer surface of each rod 104 (extending from the first axial end 108 to the second axial end 112) defines the shape of the cross-section of the rod 104 in the transverse (x-y) plane. Generally, the lateral outer surface includes a front (or inward-facing) surface 220, which is the part of the lateral outer surface that faces toward the interior volume 216, and a back surface 222 that faces away from (or at least does not face toward) the interior volume 216. In the present embodiment, the back surface 222 includes three portions, namely a back portion 224 and two side portions 226 and 228 between the back portion 224 and the front surface 220. The front surface 220 of each rod 104 contributes to defining the electric field generated in the interior volume 216. In a typical embodiment, the front surface 220 is curved toward the interior volume 216. Thus, the front surface 220 includes an apex 230 (or apical line when considering the entire axial length of the rod 104) that is the point on the rod 104 closest to the longitudinal axis L and thereby defines the radius Ro. In an embodiment and as illustrated, the curvature or profile of the front surface 220 (in the transverse plane) is hyperbolic. The hyperbolic profile is considered optimal for approximating an ideal, pure quadrupolar field. In other embodiments the profile of the front surface 220 may follow other types of curves. For example, the profile of the front surface 220 may be (semi) circular, as in the case of rods shaped as cylinders.

In an embodiment and as illustrated, the front surface 220 of each rod 104 is wide enough, and transitions to the back surface 222, such that the front surface 220 is the only part of the lateral outer surface of each rod 104 that faces the interior volume 216. That is, the interior volume 216 is exposed only to the front surface 220, which is the part of the lateral outer surface having the greatest influence on the properties (e.g., uniformity) of the electric field generated in the interior volume 216. This may be facilitated by providing smooth transitions from the front surface 220 to the back surface 222. In the illustrated embodiment, the front surface 220 of each rod 104 transitions to the back surface 222 at smoothly rounded shoulders or undercuts 234 and 236. By this configuration, the front surface 220 entirely obscures the undercuts 234 and 236 and all portions of the back surface 222 from the interior volume 216. The front surface 220 and the undercuts 234 and 236 may be carefully machined, whereas the side portions 226 and 228 are less critical and thus may be machined with less precision. In one preferred embodiment, the undercuts 234 and 236 are machined on the same set up as the front surface 220 so that the profile of the undercuts 234 and 236 have a precision relationship to the front surface 220. If the precision achieved is approximately the same as the precision of the front surface 220 itself, then the undercuts 234 and 236 can be used as surrogates for the front surface 220 when aligning entrance or exit lenses or other devices. These surrogate undercuts 234 and 236 can engage with tooling instead of the front surface 220, thus reducing the chance for scratching or contamination. Alternatively, the surrogate surfaces 234 and 236 can mate to an insulator that holds and positions the adjacent ion optics elements.

As shown in FIG. 1, each rod 104 includes a plurality of rod contact surfaces lying in the transverse plane and extending in radial directions outward from the longitudinal axis L. In the embodiment specifically illustrated, each rod 104 includes a first rod contact surface 242, a second rod contact surface 244 axially opposing the first rod contact surface 242, a third rod contact surface 246, and a fourth rod contact surface 248 axially opposing the third rod contact surface 246. The rod contact surfaces 242, 244, 246, and 248 may be formed by any suitable means. In the illustrated embodiment, the rod contact surfaces 242, 244, 246, and 248 are formed by cutting recesses 250 into the back surfaces 222 (FIG. 2) of the rods 104 at desired axial locations. The rod contact surfaces 242, 244, 246, and 248 interface with clamping systems as described below.

Generally, the rods 104 may be composed of any rigid material having good electrical conductivity, having a low coefficient of thermal expansion (CTE), and capable of being cycled between room temperature and operating temperatures of the quadrupole rod assembly without failing. Examples include various metals and metal alloys, such as stainless steel, particularly 400 series stainless steel, and more particularly 440C stainless steel.

Generally, the rods 104 may be fabricated by any process suitable for the materials employed and capable of machining the front surfaces of the rods 104 with high uniformity and accuracy. The rods 104 may be fabricated individually or from a single piece of stock material. In one embodiment, the rods 104 are fabricated from a single piece of stock material by wire electrical discharge machining (wire EDM).

Figure 3:
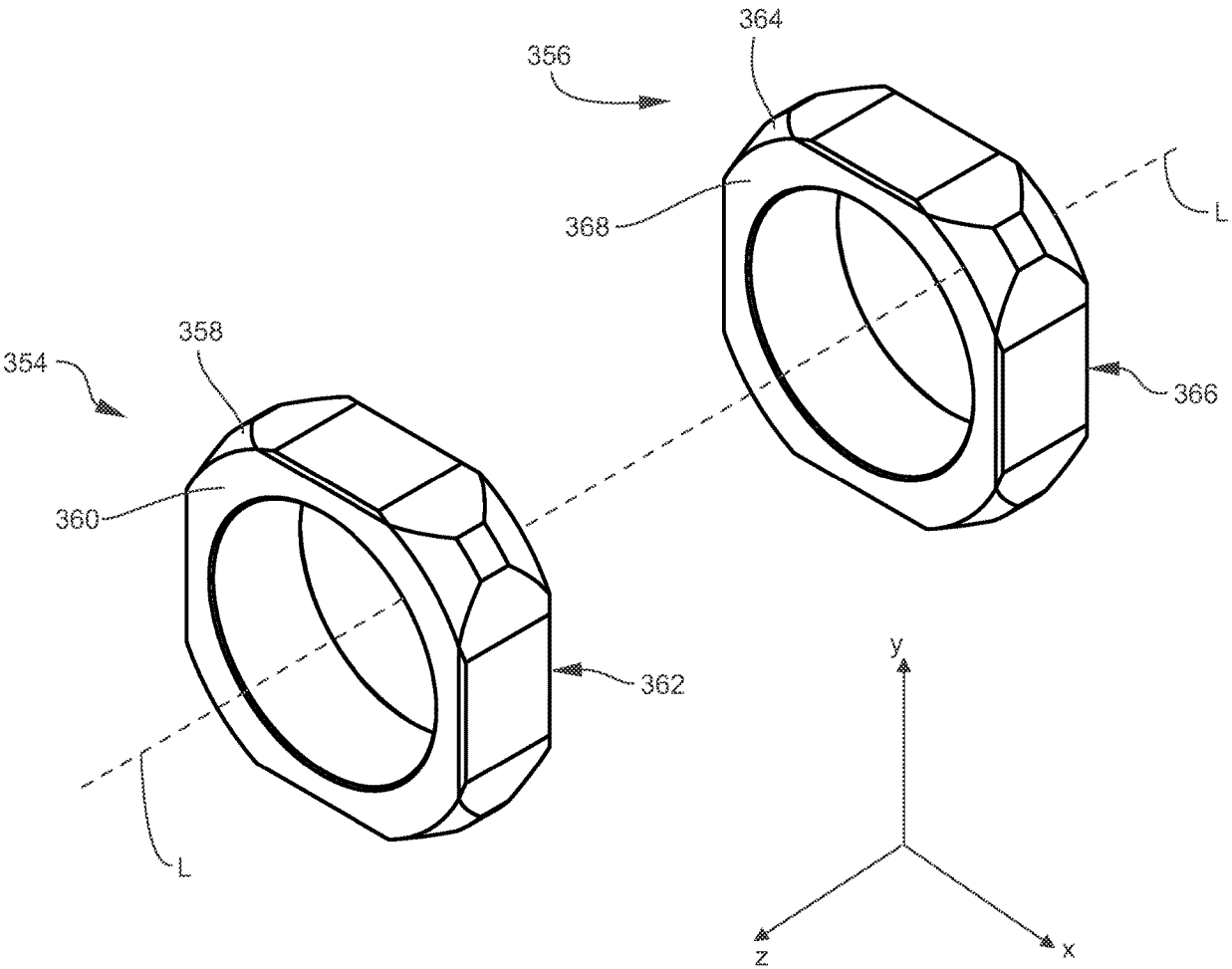
FIG. 3 is a perspective view of an example of a plurality of electrically insulating rings that may be provided in a quadrupole rod assembly according to an embodiment of the present disclosure.

FIG. 3 is a perspective view of an example of a plurality of electrically insulating rings that may be provided in a quadrupole rod assembly according to an embodiment of the present disclosure. Each ring includes opposing axial ring faces lying in the transverse plane. In the illustrated embodiment, at least a first ring 354 and a second ring 356 are provided. FIG. 3 illustrates the relative positions of the first ring 354 and the second ring 356 when the quadrupole rod assembly is in its assembled form. The first ring 354 includes a first body 358 of electrically insulating material with a first axial ring face 360 and an opposing second axial ring face 362 in the transverse (x-y) plane. Likewise, the second ring 356 includes a second body 364 of electrically insulating material with a third axial ring face 366 and an opposing fourth axial ring face 368 in the transverse plane.

The rings 354 and 356 serve as structural members that, in conjunction with the clamping systems (described below), maintain the rods 104 (FIGS. 1 and 2) in fixed positions and facilitate mounting the rods 104 in an associated instrument. The rings 354 and 356 also provide electrical insulation between the rods 104 and nearby components of the instrument, and between the clamping systems and nearby components of the instrument, so that electrical communication among various components is made solely by predetermined electrical interconnections (e.g., wires, contacts, etc.) provided as part of the assembly of the quadrupole rod assembly and associated instrument. For these purposes, the rings 354 and 356 may be composed of any rigid, electrically insulating material having a low dielectric loss tangent and a low CTE closely matching that of the rods 104. Examples include various ceramics such as, for example, alumina. Generally, the rings 354 and 356 may be fabricated by any process suitable for the materials employed. In one preferred embodiment, the rings 354 and 356 are surface ground to make the first axial ring face 360 parallel to the second axial ring face 362 and the third axial ring face 366 parallel to the fourth axial ring face 368. In some embodiments, the quadrupole rod assembly may include more than two rings 354 and 356.

Figure 4:
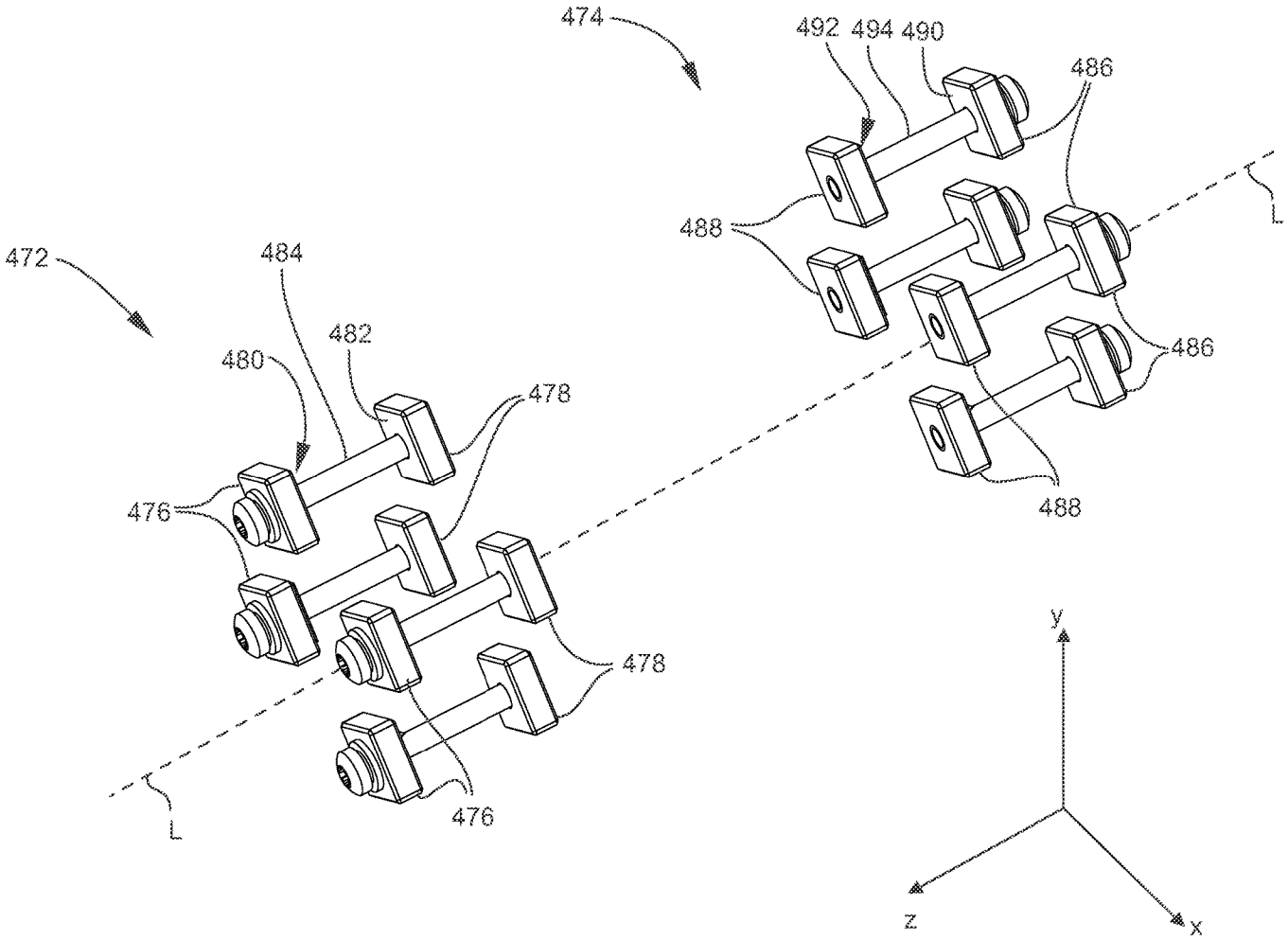
FIG. 4 is a perspective view of an example of a plurality of clamping systems that may be provided in a quadrupole rod assembly according to an embodiment of the present disclosure.

FIG. 4 is a perspective view of an example of a plurality of clamping systems that may be provided in a quadrupole rod assembly according to an embodiment of the present disclosure. Each clamping system includes a plurality of clamping components and a plurality of fastening components. In the illustrated embodiment, the quadrupole rod assembly includes at least a first clamping system 472 and a second clamping system 474. FIG. 4 illustrates the relative positions of the first clamping system 472 and the second clamping system 474, and their constituent components, when the quadrupole rod assembly is in its assembled form.

The first clamping system 472 includes a plurality of first clamping components 476 and a plurality of second clamping components 478. Each first clamping component 476 includes a first clamping face 480 lying in the transverse (x-y) plane, and each second clamping component 478 includes a second clamping face 482 lying in the transverse plane. In assembled form, each first clamping component 476 is axially aligned with a corresponding one of the second clamping components 478, such that each first clamping face 480 is positioned axially opposite to and faces the second clamping face 482 of the corresponding second clamping component 478. The first clamping system 472 further includes a plurality of first fastening components 484. In assembled form, each first fastening component 484 is configured to interface with a first clamping component 476 and a corresponding one of the second clamping components 478 such that the first ring 354 (FIG. 3) is secured between the first clamping component 476 and the second clamping component 478 in a clamped manner, as described further below.

In the illustrated embodiment, the first clamping components 476 are configured as washers with through-holes, the second clamping components 478 are configured as nuts with threaded through-holes, and the first fastening components 484 are configured as threaded fasteners (e.g., screws, bolts, etc.). Accordingly, in such embodiment each first fastening component 484 includes a head of larger diameter than the through-holes of the washers and configured to be engaged by a suitable tool (e.g., screwdriver), and an at least partially threaded shaft. During assembly, each threaded fastener is inserted through the through-hole of a corresponding washer and into threaded engagement with the threaded through-hole of a corresponding nut. A tool is then operated to engage the head of the threaded fastener and then rotate the threaded fastener, whereby the threaded fastener is translated axially further through the through-hole of the washer and the threaded through-hole of the nut. Eventually, the head of the threaded fastener comes into abutting contact with the washer. The tool is operated to apply a predetermined amount of torque to each threaded fastener so that the first clamping system 472 applies a predetermined amount of axial clamping force to the first ring 354 and the rods 104.

Similarly, the second clamping system 474 includes a plurality of third clamping components 486 and a plurality of fourth clamping components 488. Each third clamping component 486 includes a third clamping face 490 lying in the transverse plane, and each fourth clamping component 488 includes a fourth clamping face 492 lying in the transverse plane. In assembled form, each third clamping component 486 is axially aligned with a corresponding one of the fourth clamping components 488, such that each third clamping face 490 is positioned axially opposite to and faces the fourth clamping face 492 of the corresponding fourth clamping component 488. The second clamping system 474 further includes a plurality of second fastening components 494. In assembled form, each second fastening component 494 is configured to interface with a third clamping component 486 and a corresponding one of the fourth clamping components 488 such that the second ring 356 (FIG. 3) is secured between the third clamping component 486 and the fourth clamping component 488 in a clamped manner, as described further below.

In the illustrated embodiment, the third clamping components 486 are configured as washers with through-holes, the fourth clamping components 488 are configured as nuts with threaded through-holes, and the second fastening components 494 are configured as threaded fasteners, in the same manner as described above for the first clamping system 472. Accordingly, a tool is operated to apply a predetermined amount of torque to each threaded fastener so that the second clamping system 474 applies a predetermined amount of axial clamping force to the second ring 356 and the rods 104.

In the illustrated embodiment, the first clamping components 476, the second clamping components 478, the third clamping components 486 and the fourth clamping components 488 are polygonal (or prismatic), with flat sides including the first clamping faces 480, the second clamping faces 482, the third clamping faces 490 and the fourth clamping faces 492, respectively. The flat-sided geometry facilitates precisely positioning the first clamping components 476, the second clamping components 478, the third clamping components 486 and the fourth clamping components 488 relative to the rods 104 and the rings 354 and 356.

Generally, the clamping and fastening components of the first clamping system 472 and the second clamping system 474 may be composed of any rigid material having a low CTE, and capable of being cycled between room temperature and operating temperatures of the quadrupole rod assembly without failing. Examples include various metals and metal alloys. In an embodiment, the CTE of the clamping and fastening components closely matches that of the rods 104 and/or the rings 354 and 356. In an embodiment, the CTE of the clamping components is between the CTE of the rods 104 and the CTE of the rings 354 and 356. In one non-limiting example, the clamping components are titanium and the fastening components are stainless steel.

In the presently described embodiment in which the rod assembly is a quadrupole rod assembly (with four rods 104), the first clamping system 472 includes four first clamping components 476, four second clamping components 478, and four first fastening components 484. Likewise, the second clamping system 474 includes four third clamping components 486, four fourth clamping components 488, and four second fastening components 494. In such embodiment, each rod 104 is interfaced with a component group (a corresponding first clamping component 476, second clamping component 478, and first fastening component 484) of the first clamping system 472 and a component group (a corresponding third clamping component 486, fourth clamping components 488, and second fastening component 494) of the second clamping system 474. For multipole rod assemblies of higher order containing more than four rods 104, the first clamping system 472 and the second clamping system 474 may include additional clamping and fastening components.

Figure 5:
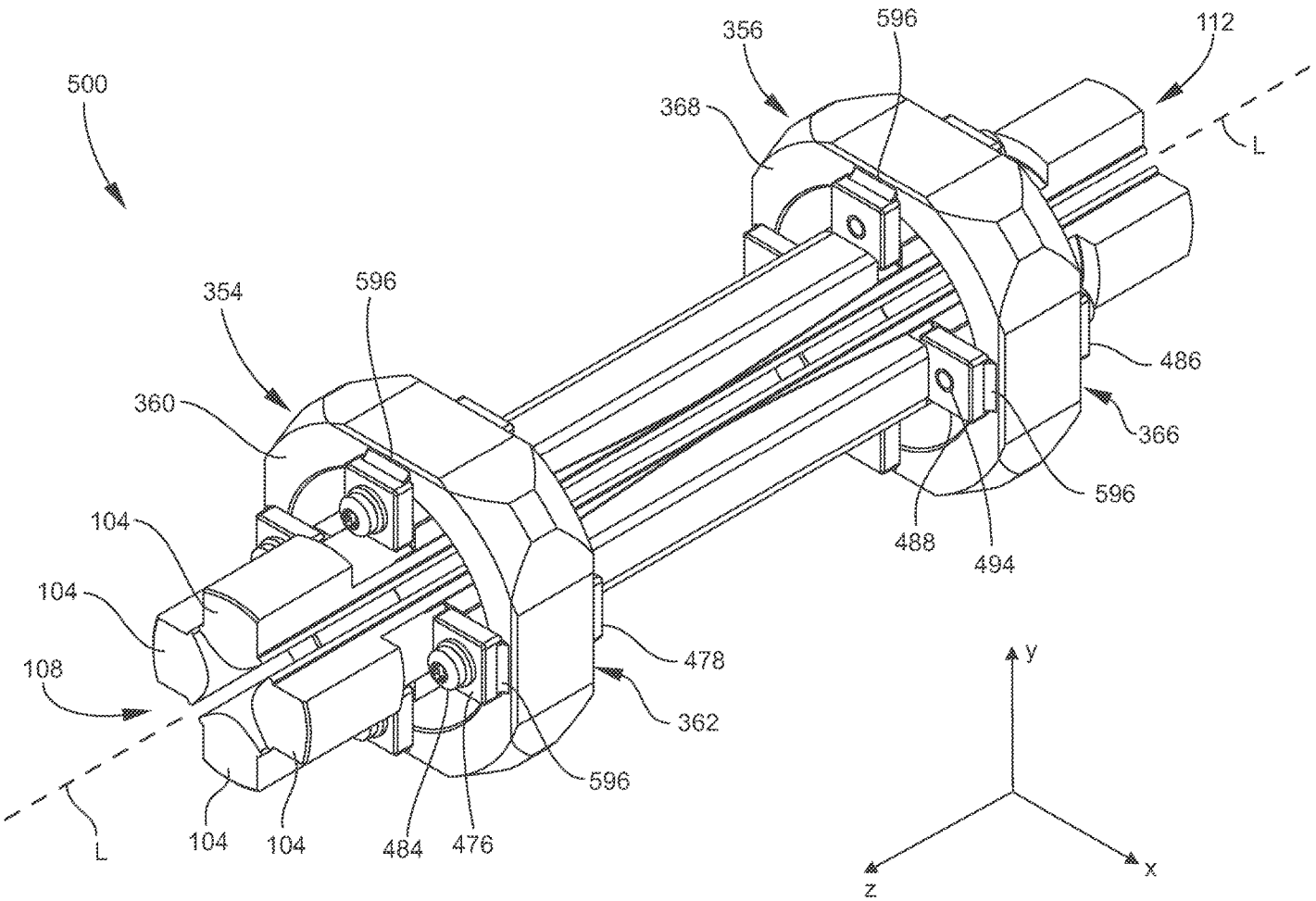
FIG. 5 is a perspective view of an example of a quadrupole rod assembly according to an embodiment of the present disclosure.
Figure 6:
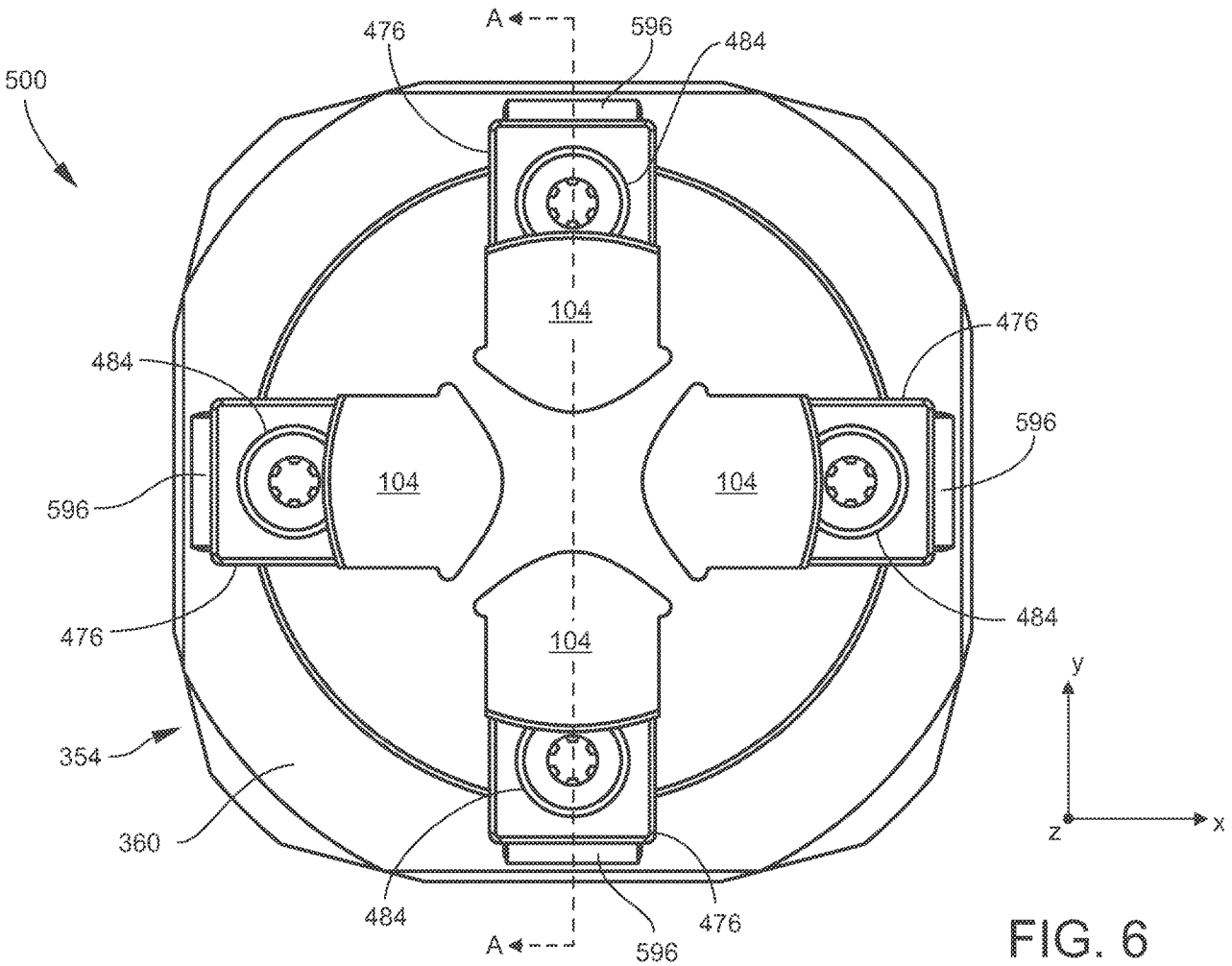
FIG. 6 is an axial end view of the quadrupole rod assembly illustrated in FIG. 5.
Figure 7:
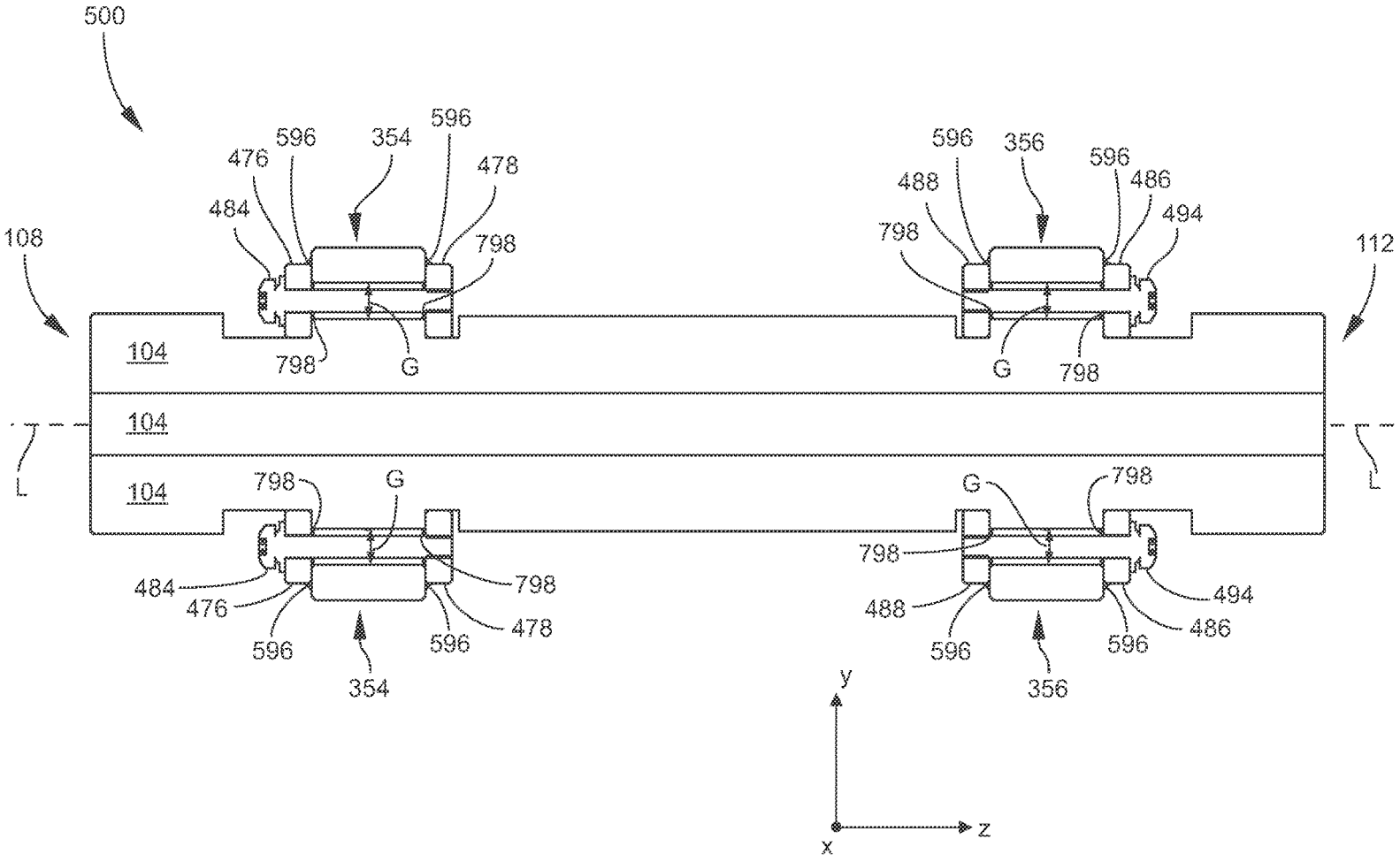
FIG. 7 is a cutaway side (end-to-end) view of the quadrupole rod assembly illustrated in FIGS. 5 and 6, where the cutaway is taken in the y-z plane at the center of the quadrupole rod assembly, as indicated by line A-A in FIG. 6.

FIG. 5 is a perspective view of an example of a quadrupole rod assembly 500 according to an embodiment of the present disclosure. The quadrupole rod assembly 500 is in fully assembled form in which the rods 104, the first ring 354, the second ring 356, and the components of the first clamping system 472 and the second clamping system 474 (FIG. 4) are fixed in position relative to each other. FIG. 6 is an axial end view of the quadrupole rod assembly 500. FIG. 7 is a cutaway side (end-to-end) view of the quadrupole rod assembly 500, where the cutaway is taken in the y-z plane at the center of the quadrupole rod assembly 500, as indicated by line A-A in FIG. 6.

In assembled form, the first ring 354 and the second ring 356 may be spaced at equal axial distances (along the longitudinal axis L) from the respective axial ends 108 and 112 of the quadrupole rod assembly 500. The rings 354 and 356 coaxially surround the rods 104 relative to the longitudinal axis L. The rings 354 and 356 are spaced from the rods 104 by a radial gap G (FIG. 7) such that an annular space exists between the outside surfaces of the rods 104 and the inside surfaces of each ring 354 and 356. The rings 354 and 356 are suspended concentrically relative to the rods 104 due to the support provided by the first clamping system 472 and the second clamping system 474. The radial gap G between the first ring 354 and the rods 104 may be referred to herein as a first radial gap (with an associated first annular space), and the radial gap G between the second ring 356 and the rods 104 may be referred to herein as a second radial gap (with an associated second annular space).

As best shown in FIG. 7 and referring also to FIGS. 1 and 4, the first clamping components 476 are positioned such that the first clamping faces 480 span the radial gap G and are in abutting contact with the first ring face 360 and respective first rod contact surfaces 242. The second clamping components 478 are positioned such that the second clamping faces 482 span the radial gap G and are in abutting contact with the second ring face 362 and respective second rod contact surfaces 244 axially opposing the corresponding first rod contact surfaces 242. Each first clamping face 480 is axially aligned with a corresponding second clamping face 482, such that each first clamping face 480 and the corresponding second clamping face 482 are positioned on opposite sides of the first ring 354 and face each other. Each first fastening component 484 extends in an axial direction parallel to the longitudinal axis L, through the through-bore of a corresponding first clamping component 476, through the radial gap G (i.e., the annular space between the corresponding rod 104 and the first ring 354), and into the threaded through-bore of a corresponding second clamping component 478. By this configuration and with the first fastening components 484 appropriately torqued, the first ring 354 and the rods 104 are securely clamped between respective pairs of axially aligned first clamping faces 480 and second clamping faces 482, such that the first ring 354 and the rods 104 are spatially fixed relative to each other in a precise manner.

Likewise, the third clamping components 486 are positioned such that the third clamping faces 490 span the radial gap G and are in abutting contact with the third ring face 366 and respective third rod contact surfaces 246. The fourth clamping components 488 are positioned such that the fourth clamping faces 492 span the radial gap G and are in abutting contact with the fourth ring face 368 and respective fourth rod contact surfaces 248. Each third clamping face 490 is axially aligned with a corresponding fourth clamping face 492, such that each third clamping face 490 and the corresponding fourth clamping face 492 are positioned on opposite sides of the second ring 356 and face each other. Each second fastening component 494 extends in an axial direction parallel to the longitudinal axis L, through the through-bore of a corresponding third clamping component 486, through the radial gap G (i.e., the annular space between the corresponding rod 104 and the second ring 356), and into the threaded through-bore of a corresponding fourth clamping component 488. By this configuration and with the second fastening components 494 appropriately torqued, the second ring 356 and the rods 104 are securely clamped between respective pairs of axially aligned third clamping faces 490 and fourth clamping faces 492, such that the second ring 356 and the rods 104 are spatially fixed relative to each other in a precise manner.

In some embodiments, the quadrupole rod assembly 500 may further include a plurality of fillets configured to enhance the security of robustness of the interfaces between the clamping components 476, 478, 486, and 488 and the rings 354 and 356, and between the clamping components 476, 478, 486, and 488 and the rods 104. The fillets may also be utilized to assist in preventing the clamping components 476, 478, 486, and 488 from slipping during assembly of the quadrupole rod assembly 500. Referring to the illustrated example of FIGS. 5-7, the quadrupole rod assembly 500 include a plurality of first (or outer) fillets 596 disposed at the interfaces between the clamping components 476, 478, 486, and 488 and the rings 354 and 356, and a plurality of second (or inner) fillets 798 (FIG. 7) disposed at the interfaces between the clamping components 476, 478, 486, and 488 and the rods 104.

Figure 8:
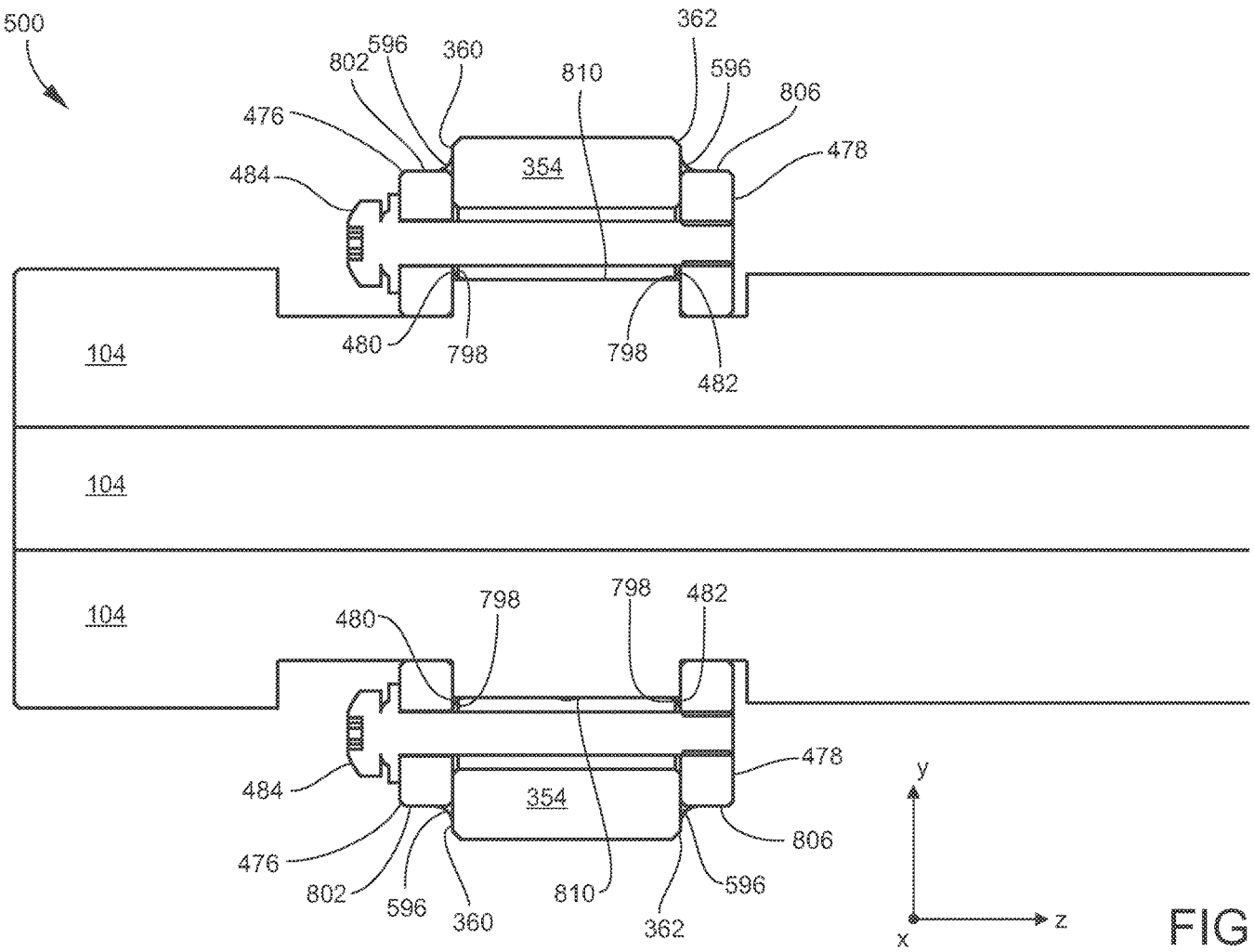
FIG. 8 is a cutaway side (end-to-end) view of the quadrupole rod assembly, similar to FIG. 7 but showing a closer view of one axial end section of the quadrupole rod assembly.

FIG. 8 is a cutaway side (end-to-end) view of the quadrupole rod assembly 500, similar to FIG. 7 but showing a closer view of one axial end section of the quadrupole rod assembly 500. FIG. 8 more clearly illustrates the first fillets 596 and the second fillets 798. In the illustrated embodiment, each first fillet 596 is disposed at the interface of (the corner formed by) the first ring face 360 and a radially outermost (relative to the longitudinal axis L) surface 802 of a corresponding first clamping component 476, or at the interface of (the corner formed by) the second ring face 362 and a radially outermost surface 806 of a corresponding second clamping component 478. Each second fillet 798 is disposed at the interface of (the corner formed by) an exposed portion of the first clamping surface 480 of a corresponding first clamping component 476 and a (typically flat) outer surface 810 of a corresponding rod 104, or at the interface of (the corner formed by) an exposed portion of the second clamping surface 482 of a corresponding second clamping component 478 and the outer surface 810 of a corresponding rod 104.

At the other axial end section (not shown in FIG. 8, but see FIG. 7) of the quadrupole rod assembly 500, the first fillets 596 and the second fillets 798 are disposed in similar locations. Accordingly, each first fillet 596 is disposed at the interface of (the corner formed by) the third ring face 366 and a radially outermost surface of a corresponding third clamping component 486, or at the interface of (the corner formed by) the fourth ring face 368 and a radially outermost surface of a corresponding fourth clamping component. Each second fillet 798 is disposed at the interface of (the corner formed by) an exposed portion of the third clamping surface 490 of a corresponding third clamping component 486 and a (typically flat) outer surface of a corresponding rod 104, or at the interface of (the corner formed by) an exposed portion of the fourth clamping surface 492 of a corresponding fourth clamping component 488 and the outer surface of a corresponding rod 104.

In an embodiment, the first fillets 596 and the second fillets 798 are composed of an adhesive material such as, for example, an epoxy (i.e., an epoxy-based formulation) or various glues or inorganic cements. The first fillets 596 and the second fillets 798 may be formed, for example, with the use of a dispensing device suitable for the adhesive material utilized. For example, depending on the type of adhesive material utilized, the adhesive material may be initially provided in a flowable state. After dispensing the adhesive material at the desired fillet sites (mating interfaces), the adhesive material may then set into respective solid fillets through a solidifying or curing mechanism (again, depending on the type of adhesive material utilized).

The quadrupole rod assembly 500 as described herein is configured such that the rods 104 and the rings 354 and 356 are spatially fixed, located, and aligned relative to each other in a highly precise manner, whereby the rods 104 are accurately positioned at predefined distances relative to each other, the rings 354 and 356 are accurately positioned at predefined distances relative to each other, and each rod 104 is accurately positioned at a predefined distance relative to each ring 354 and 356. The quadrupole rod assembly 500 is configured such that these predefined distances have minimal tolerances and are largely temperature-insensitive over the range of operating temperatures contemplated for the quadrupole rod assembly 500. That is, the quadrupole rod assembly 500 exhibits a high degree of temperature stability. Any movement between the dissimilar materials that make up the quadrupole rod assembly 500 is acceptable at least up to the operating temperatures contemplated for the quadrupole rod assembly 500, and any movement of the rods 104 due to high-mass self-heating of the instrument is minimized. These advantages are realized at least in part due to the interfaces, or mating surfaces, between the dissimilar materials (i.e., between the clamping components 476, 478, 486, and 488 and the rings 354 and 356, and between the clamping components 476, 478, 486, and 488 and the rods 104) being orthogonal to the longitudinal axis L of the quadrupole rod assembly 500. Specifically, the rod contact surfaces 242, 244, 246 and 248, the ring faces 360, 362, 366, and 368, and the clamping faces 480, 482, 490 and 492, all are oriented in the transverse (x-y) plane orthogonal to the longitudinal axis L. Moreover, the axial orientation of the fastening components 484 and 494 minimizes any distortion of the rods 104 that may occur due to heating of the rods 104 during operation of the quadrupole rod assembly 500. This configuration is in contrast to conventional multipole rod assemblies, in which the metal-to-insulator mating interfaces are parallel to the longitudinal axis L. In the conventional configuration, the components of the rod assembly are subject to differential thermal expansion stresses that cause the rods to bend due to unacceptably high bending forces (or bending moments). By contrast, the configuration of the quadrupole rod assembly 500 as described herein minimizes such bending forces.

Exemplary Embodiments

Exemplary embodiments provided in accordance with the presently disclosed subject matter include, but are not limited to, the following:

1. A quadrupole rod assembly, comprising:

at least four electrically conductive rods elongated along a longitudinal axis, the rods being circumferentially spaced from each other in a transverse plane orthogonal to the longitudinal axis, and positioned at a radius $R_o$ from the longitudinal axis, each rod comprising a plurality of rod contact surfaces in the transverse plane;

an electrically insulating first ring coaxially surrounding and spaced from the rods by a first radial gap, the first ring comprising a first ring face and an opposing second ring face in the transverse plane;

an electrically insulating second ring coaxially surrounding and spaced from the rods by a second radial gap, the second ring comprising a third ring face and an opposing fourth ring face in the transverse plane;

a first clamping system comprising a plurality of first clamping faces in the transverse plane and a plurality of second clamping faces in the transverse plane, wherein each first clamping face spans the radial gap and is in contact with the first ring face and a respective rod contact surface, each second clamping face spans the radial gap and is in contact with the second ring face and a respective rod contact surface, and the first ring and the rods are clamped between the first clamping faces and the second clamping faces such that the first ring and the rods are spatially fixed relative to each other; and a second clamping system comprising a plurality of third clamping faces in the transverse plane and a plurality of fourth clamping faces in the transverse plane, wherein each third clamping face spans the radial gap and is in contact with the third ring face and a respective rod contact surface, each fourth clamping face spans the radial gap and is in contact with the fourth ring face and a respective rod contact surface, and the second ring and the rods are clamped between the third clamping faces and the fourth clamping faces such that the second ring and the rods are spatially fixed relative to each other.

2. The quadrupole rod assembly of embodiment 1, wherein the rods coaxially surround an interior volume elongated along the longitudinal axis, and the rods comprise respective curved front surfaces facing the interior volume.

3. The quadrupole rod assembly of embodiment 2, wherein the curved front surfaces have respective apices defining the radius $R_o$.

4. The quadrupole rod assembly of embodiment 2 or 3, wherein the curved front surfaces are hyperbolic from the perspective of the transverse plane.

5. The quadrupole rod assembly of any of embodiments 2-4, wherein each rod comprises an outer surface, and the outer surface comprises the curved front surface and a back surface to which the curved front surface transitions, and the curved front surface obscures the back surface from the interior volume.

6. The quadrupole rod assembly of any of embodiments 2-5, wherein each rod comprises an outer surface, and the outer surface comprises the curved front surface, a back surface, and two lateral surfaces between the front surface and the back surface, wherein the curved front surface transitions to the two lateral surfaces via two undercuts, respectively, and the curved front surface obscures the two undercuts from the interior volume.

7. The quadrupole rod assembly of any of embodiments 2-6, wherein each rod further comprises at least two surfaces placed out of direct line of sight to the longitudinal axis, the at least two surfaces being held in geometrical relationship to the curved front surface to allow the at least two surfaces to act as surrogates for the front surface for mounting or aligning mating optics at an entrance of the quadrupole rod assembly, an exit of the quadrupole rod assembly, or both the entrance and the exit.

8. The quadrupole rod assembly of any of the preceding embodiments, wherein the first clamping faces, the second clamping faces, the third clamping faces, and the fourth clamping faces have a coefficient of thermal expansion between a coefficient of thermal expansion of the rods and a coefficient of thermal expansion of the first ring and the second ring.

9. The quadrupole rod assembly of any of the preceding embodiments, wherein:

the first clamping system comprises a plurality of first clamping components comprising the respective first clamping faces, and a plurality of second clamping components comprising the respective second clamping faces; and the second clamping system comprises a plurality of third clamping components comprising the respective third clamping faces, and a plurality of fourth clamping components comprising the respective fourth clamping faces.

10. The quadrupole rod assembly of embodiment 9, wherein the first clamping components, the second clamping components, the third clamping components, and the fourth clamping components are polygonal.

11. The quadrupole rod assembly of embodiment 9 or 10, wherein:

the first clamping system comprises a plurality of first fastening components, each first fastening component engaging one of the first clamping components and a corresponding one of the second clamping components; and the second clamping system comprises a plurality of second fastening components, each second fastening component engaging one of the third clamping components and a corresponding one of the fourth clamping components.

12. The quadrupole rod assembly of embodiment 11, wherein the first fastening components and the second fastening components extend along axial directions parallel to the longitudinal axis.

13. The quadrupole rod assembly of embodiment 11 or 12, wherein the first fastening components extend through the first radial gap and the second fastening components extend through the second radial gap.

14. The quadrupole rod assembly of any of embodiments 11-13, wherein the first clamping components and the third clamping components comprise respective washers, the second clamping components and the fourth clamping components comprise respective nuts, and the first fastening components and the second fastening components comprise respective threaded fasteners.

15. The quadrupole rod assembly of any of the preceding embodiments, wherein:

the first clamping system comprises:

at least four first clamping components comprising respective first clamping faces, each first clamping component extending radially outwardly from a corresponding one of the rods;

at least four second clamping components comprising respective second clamping faces, each second clamping component extending radially outwardly from a corresponding one of the rods; and at least four first fasteners, each first fastener engaging a corresponding first clamping component and a second clamping component axially aligned with the corresponding first clamping component; and the second clamping system comprises:

at least four third clamping components comprising respective third clamping faces, each third clamping component extending radially outwardly from a corresponding one of the rods;

at least four fourth clamping components comprising respective fourth clamping faces, each fourth clamping component extending radially outwardly from a corresponding one of the rods; and at least four second fasteners, each second fastener engaging a corresponding third clamping component and a fourth clamping component axially aligned with the corresponding third clamping component.

16. The quadrupole rod assembly of any of the preceding embodiments, comprising a plurality of fillets respectively disposed at interfaces selected from the group consisting of:

respective interfaces between the first ring and the first clamping faces and between the first ring and the second clamping faces;

respective interfaces between the rods and the first clamping faces and between the rods and the and the second clamping faces;

respective interfaces between the second ring and the third clamping faces and between the second ring and the fourth clamping faces;

respective interfaces between the rods and the third clamping faces and between the rods and the fourth clamping faces; and a combination of two or more of the foregoing.

17. The quadrupole rod assembly of embodiment 16, wherein the fillets are composed of an adhesive material.

18. An ion processing device, comprising:

the quadrupole rod assembly of any of the preceding embodiments; and a voltage source communicating with the rods, wherein the rods are configured for generating a quadrupole electric field in an interior volume surrounded by the rods.

19. The ion processing device of embodiment 18, wherein the voltage source is configured for applying RF and DC voltages between the rods, such that only ions having one or more selected m/z ratios are stable in the quadrupole electric field.

20. A spectrometry system, comprising:

the quadrupole rod assembly of any of the preceding embodiments; and an ion detector configured to receive ions transmitted from the quadrupole rod assembly.

21. The spectrometry system of embodiment 20, comprising an ion processing device, wherein the ion processing device comprises the quadrupole rod assembly.

22. The spectrometry system of embodiment 21, wherein the ion processing device is selected from the group consisting of: a mass analyzer, a mass filter, an ion guide, an ion trap, an ion beam cooler, and an ion fragmentation device.

It will be understood that the term "in signal communication" or "in electrical communication" as used herein means that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A quadrupole rod assembly, comprising:

at least four electrically conductive rods elongated along a longitudinal axis, the rods being circumferentially spaced from each other in a transverse plane orthogonal to the longitudinal axis, and positioned at a radius $R_o$ from the longitudinal axis, each rod comprising a plurality of rod contact surfaces in the transverse plane;

an electrically insulating first ring coaxially surrounding and spaced from the rods by a first radial gap, the first ring comprising a first ring face and an opposing second ring face in the transverse plane;

an electrically insulating second ring coaxially surrounding and spaced from the rods by a second radial gap, the second ring comprising a third ring face and an opposing fourth ring face in the transverse plane;

a first clamping system comprising a plurality of first clamping faces in the transverse plane and a plurality of second clamping faces in the transverse plane, wherein each first clamping face spans the radial gap and is in contact with the first ring face and a respective rod contact surface, each second clamping face spans the radial gap and is in contact with the second ring face and a respective rod contact surface, and the first ring and the rods are clamped between the first clamping faces and the second clamping faces such that the first ring and the rods are spatially fixed relative to each other; and a second clamping system comprising a plurality of third clamping faces in the transverse plane and a plurality of fourth clamping faces in the transverse plane, wherein each third clamping face spans the radial gap and is in contact with the third ring face and a respective rod contact surface, each fourth clamping face spans the radial gap and is in contact with the fourth ring face and a respective rod contact surface, and the second ring and the rods are clamped between the third clamping faces and the fourth clamping faces such that the second ring and the rods are spatially fixed relative to each other.

2. The quadrupole rod assembly of claim 1, wherein the rods coaxially surround an interior volume elongated along the longitudinal axis, and the rods comprise respective curved front surfaces facing the interior volume.

3. The quadrupole rod assembly of claim 2, wherein the curved front surfaces have respective apices defining the radius $R_o$.

4. The quadrupole rod assembly of claim 2, wherein the curved front surfaces are hyperbolic from the perspective of the transverse plane.

5. The quadrupole rod assembly of claim 2, wherein each rod comprises an outer surface, and the outer surface comprises the curved front surface and a back surface to which the curved front surface transitions, and the curved front surface obscures the back surface from the interior volume.

6. The quadrupole rod assembly of claim 2, wherein each rod comprises an outer surface, and the outer surface comprises the curved front surface, a back surface, and two lateral surfaces between the front surface and the back surface, wherein the curved front surface transitions to the two lateral surfaces via two undercuts, respectively, and the curved front surface obscures the two undercuts from the interior volume.

7. The quadrupole rod assembly of claim 2, wherein each rod further comprises at least two surfaces placed out of direct line of sight to the longitudinal axis, the at least two surfaces being held in geometrical relationship to the curved front surface to allow the at least two surfaces to act as surrogates for the front surface for mounting or aligning mating optics at an entrance of the quadrupole rod assembly, an exit of the quadrupole rod assembly, or both the entrance and the exit.

8. The quadrupole rod assembly of claim 1, wherein the first clamping faces, the second clamping faces, the third clamping faces, and the fourth clamping faces have a coefficient of thermal expansion between a coefficient of thermal expansion of the rods and a coefficient of thermal expansion of the first ring and the second ring.

9. The quadrupole rod assembly of claim 1, wherein:

the first clamping system comprises a plurality of first clamping components comprising the respective first clamping faces, and a plurality of second clamping components comprising the respective second clamping faces; and the second clamping system comprises a plurality of third clamping components comprising the respective third clamping faces, and a plurality of fourth clamping components comprising the respective fourth clamping faces.

10. The quadrupole rod assembly of claim 9, wherein the first clamping components, the second clamping components, the third clamping components, and the fourth clamping components are polygonal.

11. The quadrupole rod assembly of claim 9, wherein:

the first clamping system comprises a plurality of first fastening components, each first fastening component engaging one of the first clamping components and a corresponding one of the second clamping components; and the second clamping system comprises a plurality of second fastening components, each second fastening component engaging one of the third clamping components and a corresponding one of the fourth clamping components.

12. The quadrupole rod assembly of claim 11, wherein the first fastening components and the second fastening components extend along axial directions parallel to the longitudinal axis.

13. The quadrupole rod assembly of claim 11, wherein the first fastening components extend through the first radial gap and the second fastening components extend through the second radial gap.

14. The quadrupole rod assembly of claim 11, wherein the first clamping components and the third clamping components comprise respective washers, the second clamping components and the fourth clamping components comprise respective nuts, and the first fastening components and the second fastening components comprise respective threaded fasteners.

15. The quadrupole rod assembly of claim 1, wherein:

the first clamping system comprises:

at least four first clamping components comprising respective first clamping faces, each first clamping component extending radially outwardly from a corresponding one of the rods;

at least four second clamping components comprising respective second clamping faces, each second clamping component extending radially outwardly from a corresponding one of the rods; and at least four first fasteners, each first fastener engaging a corresponding first clamping component and a second clamping component axially aligned with the corresponding first clamping component; and the second clamping system comprises:

at least four third clamping components comprising respective third clamping faces, each third clamping component extending radially outwardly from a corresponding one of the rods;

at least four fourth clamping components comprising respective fourth clamping faces, each fourth clamping component extending radially outwardly from a corresponding one of the rods; and at least four second fasteners, each second fastener engaging a corresponding third clamping component and a fourth clamping component axially aligned with the corresponding third clamping component.

16. The quadrupole rod assembly of claim 1, comprising a plurality of fillets respectively disposed at interfaces selected from the group consisting of:

respective interfaces between the first ring and the first clamping faces and between the first ring and the second clamping faces;

respective interfaces between the rods and the first clamping faces and between the rods and the and the second clamping faces;

respective interfaces between the second ring and the third clamping faces and between the second ring and the fourth clamping faces;

respective interfaces between the rods and the third clamping faces and between the rods and the fourth clamping faces; and a combination of two or more of the foregoing.

17. The quadrupole rod assembly of claim 16, wherein the fillets are composed of an adhesive material.

18. An ion processing device, comprising:

the quadrupole rod assembly of claim 1; and a voltage source communicating with the rods, wherein the rods are configured for generating a quadrupole electric field in an interior volume surrounded by the rods.

19. The ion processing device of claim 18, wherein the voltage source is configured for applying RF and DC voltages between the rods, such that only ions having one or more selected m/z ratios are stable in the quadrupole electric field.

20. A spectrometry system, comprising:

the quadrupole rod assembly of claim 1; and an ion detector configured to receive ions transmitted from the quadrupole rod assembly.

* * * * *